US005693457A

United States Patent [19]

Kojima et al.

[11] Patent Number: 5,693,457

[45] Date of Patent: Dec. 2, 1997

[54] SILVER HALIDE COLOR PHOTOGRAPHIC LIGHT SENSITIVE MATERIAL

[75] Inventors: Takaaki Kojima; Yasuhiko Kawashima; Tomoyuki Nakayama, all of Hino, Japan

[73] Assignee: Konica Corporation, Japan

[21] Appl. No.: 576,499

[22] Filed: Dec. 21, 1995

[30] Foreign Application Priority Data

Dec. 26, 1994 [JP] Japan ..... 6-321110

[51] Int. Cl.[6] ..... G03C 1/83; G03C 1/09

[52] U.S. Cl. ..... 430/507; 430/517; 430/603; 430/522

[58] Field of Search ..... 430/517, 603, 430/507, 522

[56] References Cited

U.S. PATENT DOCUMENTS

| | | | |
|---|---|---|---|
| 4,923,788 | 5/1990 | Shuttleworth et al. | 430/507 |
| 5,158,892 | 10/1992 | Sasaki et al. | 430/603 |
| 5,236,821 | 8/1993 | Yagihara et al. | 430/600 |
| 5,238,807 | 8/1993 | Sasaki et al. | 430/600 |
| 5,273,874 | 12/1993 | Kojima et al. | 430/600 |
| 5,360,702 | 11/1994 | Zengerle et al. | 430/505 |
| 5,395,745 | 3/1995 | Maruyama et al. | 430/567 |
| 5,457,014 | 10/1995 | Zengerle et al. | 430/505 |
| 5,514,534 | 5/1996 | Nozawa et al. | 430/603 |
| 5,573,899 | 11/1996 | Kase | 430/517 |
| 5,573,901 | 11/1996 | Yamashita et al. | 430/567 |

*Primary Examiner*—Mark F. Huff

*Attorney, Agent, or Firm*—Jordan B. Bierman; Bierman, Muserlian and Lucas LLP

[57] ABSTRACT

A silver halide color photographic light sensitive material is disclosed, comprising a support having thereon hydrophilic colloid layers including a silver halide emulsion layer, wherein the silver halide emulsion layer contains photosensitive silver halide grains which have been selenium-sensitized or tellurium sensitized; and at least one of the hydrophilic colloid layers contains an organic dye represented by the following formula.

Formula (I)

14 Claims, No Drawings

SILVER HALIDE COLOR PHOTOGRAPHIC LIGHT SENSITIVE MATERIAL

FIELD OF THE INVENTION

The present invention relates to a silver halide color photographic light sensitive material and particularly to a silver halide color photographic light sensitive material with high sensitivity and superior storage stability and improved in processing stability.

BACKGROUND OF THE INVENTION

A silver halide emulsion which has been used for a color camera material is usually chemical-sensitized with various kinds of compounds to obtain desired sensitivity and contrast. As representative methods of chemical sensitization, there have been known sulfur sensitization, selenium sensitization, tellurium sensitization, noble metal(e.g., gold) sensitization, reduction sensitization and a combination thereof.

A color photographic material for camera use comprises photosensitive layers sensitized to three primary ranges of visible spectrum, i.e., blue, green and red spectrum. Silver halide used therein has inherently sensitivity to blue light. A sensitizing dye adsorbed to silver halide grains leads to enhancement of sensitivity to blue light as well as sensitivity to green or red light, so that spectrally sensitized silver halide maintains inherent sensitivity to blue light.

In the case when blue light reaches a blue-sensitive and red-sensitive layer containing silver halide grains sensitized to a spectral range other than blue, these layers are exposed to the blue light to become developable due to the inherent sensitivity to blue light, leading to provide a false portrayal of an image information. Accordingly, in a color photographic material comprising plural photosensitive layers different in spectral sensitivity with each other, a blue-sensitive layer is usually provided at a position nearest to a exposing light source and a blue-absorbing layer or yellow filter layer is arranged between the blue-sensitive layer and the green-sensitive and red-sensitive layers.

There is generally employed yellow colloidal silver, so-called Carey-Lea silver, which is capable of absorbing blue light and being removed readily during the course of processing such as bleaching and fixing. However, the Carey-Lea silver has an unwanted absorption in a spectral range of green, further causing to fog silver halide grains contained in a layer adjacent to the yellow colloid-containing layer. Particularly, in the case when sensitized by a combination of sulfur sensitization, selenium sensitization or tellurium sensitization with gold sensitizatioin, silver halide grains are susceptible to be fogged, further having a tendency of increasing fog during the storage thereof. Accordingly, there has been desired an improvement toward these defects.

In place of Carey-lea silver, there have been proposed a number of yellow dyes described in U.S. Pat. Nos. 2,538,008, 2,538,009 and 4,420,555; British Patent Nos. 695,873 and 760,739; JP-A 3-20732 (1991) 3-238447 (1991) and 4-14035 (1992). These dyes exhibit a necessary absorption of blue light but were found to have such defects that the absorption was not sufficient or the processing stability was deteriorated with respect to fog.

SUMMARY OF THE INVENTION

In view of the above problems, an object of the present invention is to provide a silver halide color photographic light-sensitive material with high sensitivity and improved in fogging on storage and processing.

The above object can be solved by the following constitution.

(1) A silver halide color photographic light sensitive material comprising a support having thereon hydrophilic colloid layers including a silver halide emulsion layer, wherein said silver halide emulsion layer contains photosensitive silver halide grains which have been selenium-sensitized or tellurium sensitized; and at least one of the hydrophilic colloid layers contains an organic dye.

(2) The silver halide color photographic light sensitive material described in (1), wherein said organic dye is a compound represented by the following formula (I),

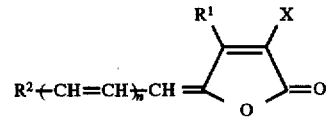

formula (I)

wherein $R^1$ and $R^2$ represents an alkyl group, alkenyl group, alkynyl group, aryl group or heterocyclic group; X represents —CN, $COOR^3$, $—CONR^3R^4$, $—SO_2NR^3R^4$, $—COR^3$, $—SO_2R^3$ or $—CF_3$, in which $R^3$ and $R^4$ represent a hydrogen atom, alkyl group, alkenyl group, alkynyl group, aryl group or heterocyclic group; n is an integer of 0, 1 and 2.

DETAILED DESCRIPTION OF THE INVENTION

Selenium-sensitizers include various selenium compounds described in U.S. Pat. Nos. 1,574,944, 1,602,592 and 1,623,499, JP-A 60-150046 (1992), 4-25832 (1992), 4-109240 (1992) and 4-147250 (1992). Usable selenium sensitizers include colloidal (elemental) selenium, isoselenocyanates such as allylisoselenocyanate; selenoureas such as N,N-dimethylselenourea, N,N,N'-triethylselenourea, N,N,N'-trimethyl-N'-heptafluoropropylselenourea, N,N,N'-trimethyl-N'heptafluoropropylcarbonylselenourea and N,N,N'-trimethyl-N'-nitrophenylcarbonylselenourea; selenoketones such as selenoacetone and selenoacetophenone; selenoamides such as selenoacetoamide and N,N-dimethylbenzamide; selenocarboxylic acids and esters thereof such as 2-propionic acid and methyl 3-selenobutylate; selenophosphates such as tri-p-triselenophosphate; and selenides such as diethylselenide, diethyldiselenide and triphosphine selenide. Preferable selenium sensitizers are selenoureas, selenoamides, selenophosphates and selenoketones. Techniques of using these selenium sensitizers are disclosed in U.S. Pat. Nos. 1,574,944, 1,602,592, 1,623,499, 3,297,446, 3,297,447, 3,320,069, 3,408,196, 3,408,197, 3,442,653, 3,420,670 and 3,591,385, French patent Nos. 2,93,038 and 2,093,209, Japanese Patent examined Nos. 52-34491 (1977), 52-34492 (1977), 53-295 (1978) and 57-22090 (19782), JP-A 59-180536 (1984), 59-185330 (1984), 59-181337 (1984), 59-187338 (1984), 59-192241 (1984), 60-150046 (1985), 60-151637 (1985), 61-246738 (1986), 3-4221 (1991), 3-24537 (1991), 3-111838 (1991), 3-116132 (1991), 3-148648 (1991), 3-237450 (1991), 4-16838 (1992), 4-25832 (1992), 4-32831 (1992), 4-96059 (1992), 4-109240 (1992), 4-140738 (1992), 4-147250 (1992), 4-149437, 4-184331, 4-190225, 4-191729 (1992) and 4-195035, British patent Nos. 255,846 and 861,984, and also in H. E. Spencer, Journal of Photographic Science Vol.31, pp 158–169 (1983).

The using amount of the selenium sensitizer is variable depending on a selenium compound, silver halide grains and the condition of chemical sensitization and generally in a range of $1\times10^{-8}$ to $1\times10^{-4}$ mol per mol of silver halide. The selenium sensitizer can be added by dissolving in an organic solvent such as methanol or ethanol or a mixture thereof. The sensitizer may be added in the form of a gelatin solution thereof or dispersion of an organic solvent-soluble polymer disclosed in JP-A 4-140739 (1992).

Chemical ripening with the use of the selenium sensitizer is carried out at a temperature of 40° to 90° C., preferably, 45° to 80° C. The pH and pAg thereof are preferably in a range of 4 to 9 and 6 to 9.5, respectively.

Tellurium sensitizers of the invention and sensitizing methods thereof are disclosed in U.S. Pat. Nos. 1,623,499, 3,320,069, 3,772,031, 3,531,289 and 3,655,394, British patent No. 235,211, 1,121,496, 1,295,462 and 1,396,696, Canada Patent No. 800,958, JP-A 4-204640 (1992) and 4-333043 (1992). Examples of usable tellurium sensitizers include telluroureas such as N,N-dimethyltellurourea, tetramethyltellurourea, N-carboxyethyl-N,N'-dimethyltellurourea and N,N'-dimethyl-N'-phenyltellurourea; phosphine tellurides such as tributylphosphine telluride, tricyclohexylphosphine telluride, triisopropylphosphintelluride, butyldiisopropylphosphin telluride and dibutylphenylphosphine telluride; telluroamides such as telluroacetoamide and N,N-dimethyltellurobenzamide, telluroketones; telluroesters and isotellurocyanates. Technique of using the tellurium sensitizer is similar to that of the selenium sensitizer.

In the present invention, the sensitizer is preferably used in combination with a noble metal sensitizer such as gold, platinum, palladium or iridium. It is more preferable to make use in combination with a gold sensitizer such as chloroauric acid, potassium chloroaurate, potassium aurothiocyanate, gold sulfide or gold selenide, which can be used in an amount of $1\times10^{-7}$ to $1\times10^{-2}$ mol per mol of silver halide.

In the present invention, it is preferable to make use in combination of a sulfur sensitizer. As examples thereof are cited a thiosulfate such as sodium thiosulfate, thiourea such as diphenylthiourea, triethylthiourea or allylthiourea, elemental sulfur and labile sulfur compound such as rhodanine. These compound can be used in an amount of $1\times10^{-7}$ to $1\times10^{-2}$ mol per mol of silver halide.

In the present invention, it is feasible to make use in combination with a reduction sensitizer such as a hydrazine derivative, stannous chloride, aminoiminomethanesulfinic acid, borane compound or polyamine compound.

In the present invention, the selenium sensitization and/or tellurium sensitization may be carried out in the presence of a silver halide solvent including thiocyanates such as potassium thiocyanate and ammonium thiocyanate, which may be used in an amount of $1\times10^{-5}$ to $1\times10^{-2}$ mol per mol of silver halide.

In the invention, an organic dye is contained in at least one of photosensitive silver halide emulsion layer(s) and photo-insensitive layer(s). The organic dye is preferably a compound represented by formula (I) afore-described.

The compound represented by formula (I) will be explained as below.

In formula (I), an alkyl group represented by $R^1$, $R^2$, $R^3$ and $R^4$ includes methyl, ethyl, propyl, isopropyl, butyl, t-butyl, pentyl cyclopentyl, hexyl, cyclohexyl, octyl, 2-ethylhexyl or dodecyl. The alkyl group may be substituted by a halogen atom such as chlorine, bromine or fluorine; an alkoxy group such as methoxy, ethoxy, 1,1-dimethylethoxy, hexyloxy or dodecyloxy; aryloxy group such as pheoxy or naphthyloxy; aryl group such as phenyl or naphthyl; alkoxycarbonyl group such as methoxycarbonyl, ethoycarbonylbutoxycarbonyl or 2-ethyl-hexylcarbonyl; aryloxycarbonyl group such as phenoxycarbonyl or naphthyloxycarbonyl; alkenyl group such as vinyl or allyl; heterocyclic group such as 2-pyridyl, 3-pyridyl, 4-pyridyl, morpholyl, piperidyl, piperazyl, pirimidyl, pyrrazolyl or furyl; alkynyl group such as propargyl, amino group such as amino, N,N-dimethylaminoor anilino; hydroxy group; cyano group; sulfo group; carboxy group or sulfonylamino group such as methylsulfonylamino, ethylsulfonylamino, butylsulfonylamino, octylsulfonylamino or phenylsulfonylamino.

Examples of an alkenyl group represented by $R^1$, $R^2$, $R^3$ and $R^4$ include vinyl and allyl. The alkenyl group may be substituted by an alkyl group or a group above-described as a substituent of the alkyl group.

An alkynyl group represented by $R^1$, $R^2$, $R^3$ and $R^4$ includes propargyl. The alkynyl group may be substituted by an alkyl group or a group above-described as a substituent of the alkyl group.

Examples of an aryl group represented by $R^1$, $R^2$, $R^3$ and $R^4$ include a phenyl and naphthyl group. The aryl group may be substituted by an alkyl group or a group above-described as a substituent of the alkyl group.

Examples of a heterocyclic group represented by $R^1$, $R^2$, $R^3$ and $R^4$ include a pyridyl group such as 2-pyridyl, 3-pyridyl or 4-pyridyl; thiazolyl group, oxazolyl group; imidazolyl group; furyl group; thienyl group; pyrrolyl group; pyrazinyl group; pyrimidinyl group; pyridazinyl group; selenazolyl group; sulforanyl group; piperidynyl group; pyrazolyl group or tetrazolyl group. These group may be substituted by an alkyl group or a group above-described as a substituent of the alkyl group.

In a preferred embodiment of the invention, the dye represented by formula (I) is an yellow dye.

Examples of the dye are shown below but the present invention is not limited thereto.

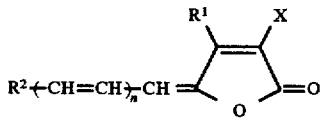
| No. | −X | −R¹ | n | −R² |
|---|---|---|---|---|
| 1 | −CN | 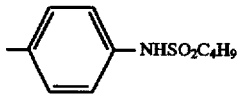 | 0 | 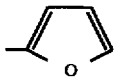 |
| 2 | −CN | 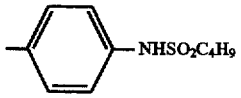 | 0 | 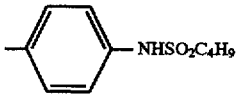 |
| 3 | −CN | 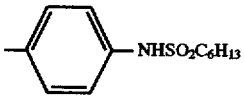 | 0 | 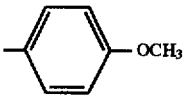 |
| 4 | −CN | 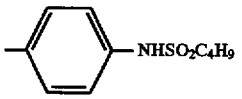 | 0 | 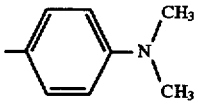 |
| 5 | −CN | 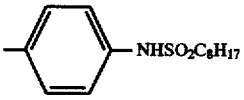 | 0 | 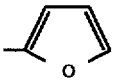 |
| 6 | −CN | 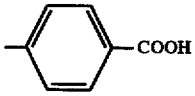 | 0 | 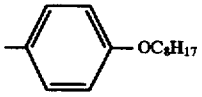 |
| 7 | −CN | 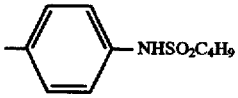 | 0 | 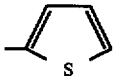 |
| 8 | −CN | 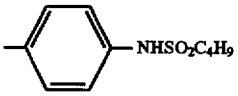 | 0 | 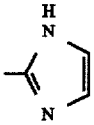 |
| 9 | −CN | 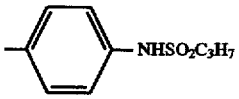 | 0 | 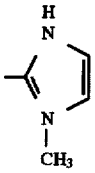 |
| 10 | −CN | 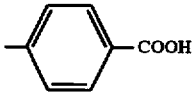 | 0 | 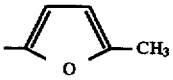 |
| 11 | −CN | 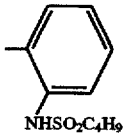 | 0 | 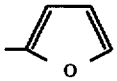 |

-continued
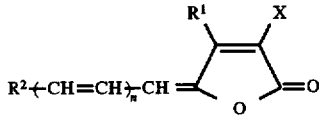
| No. | −X | −R¹ | n | −R² |
|---|---|---|---|---|
| 12 | −CN | 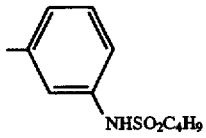 | 0 | 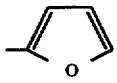 |
| 13 | $-COOC_2H_5$ | 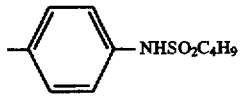 | 0 | 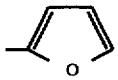 |
| 14 | $-COOC_3H_7$ | 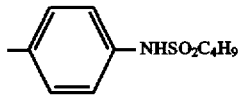 | 0 | 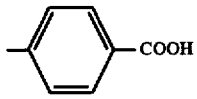 |
| 15 | 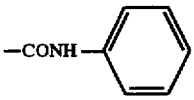 | 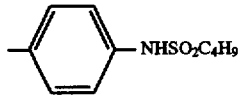 | 0 | 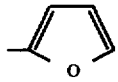 |
| 16 | $-CONHC_3H_7$ | 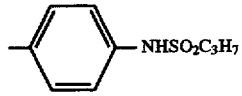 | 0 | 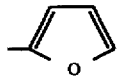 |
| 17 | 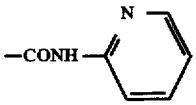 | 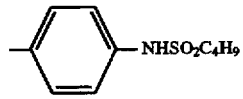 | 0 | 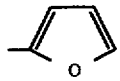 |
| 18 | $-CON(C_3H_7)_2$ | 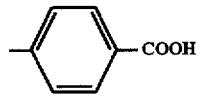 | 0 | 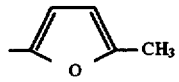 |
| 19 | 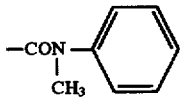 | 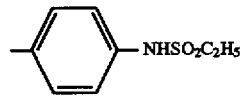 | 0 | 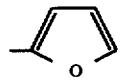 |
| 20 | 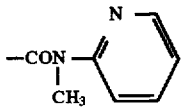 | 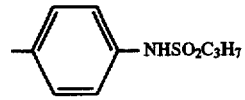 | 0 | 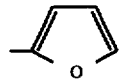 |
| 21 | 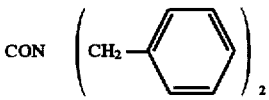 | 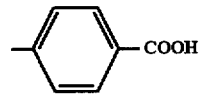 | 0 | 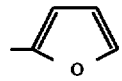 |
| 22 | 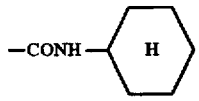 | 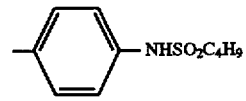 | 0 | 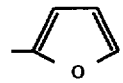 |
| 23 | 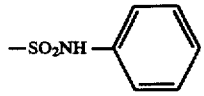 | 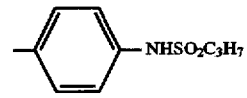 | 0 | 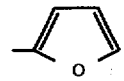 |
| 24 | $-SO_2NHC_4H_9$ | 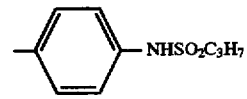 | 0 | 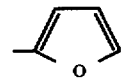 |

-continued
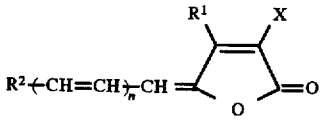
| No. | −X | −R¹ | n | −R² |
|---|---|---|---|---|
| 25 | $-SO_2C_4H_9$ | 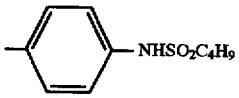 | 0 | 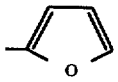 |
| 26 | 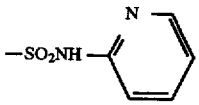 | 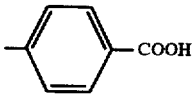 | 0 | 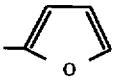 |
| 27 | $-COOC_4H_9$ | 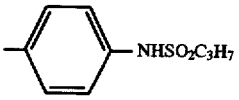 | 0 | 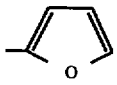 |
| 28 | $-COCH_3$ | 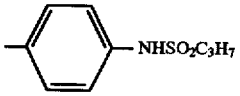 | 0 | 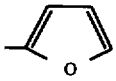 |
| 29 | $-COC_3H_7$ | 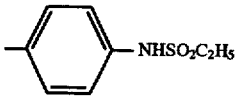 | 0 | 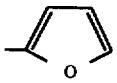 |
| 30 | −CN | 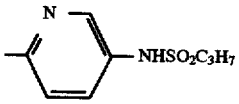 | 0 | 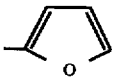 |
| 31 | −CN | 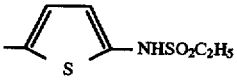 | 0 | 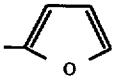 |
| 32 | −CN | 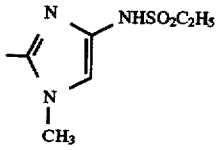 | 0 | 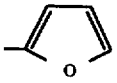 |
| 33 | −CN | 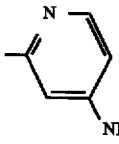 | 0 | 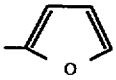 |
| 34 | $-COOC_2H_5$ | 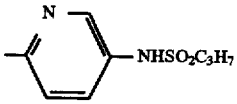 | 0 | 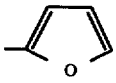 |
| 35 | $-COOC_2H_5$ | 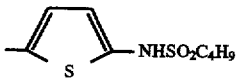 | 0 | 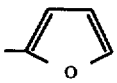 |
| 36 | 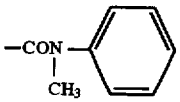 | 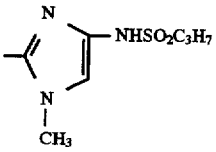 | 0 | 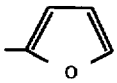 |

-continued
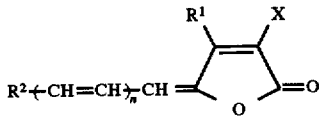
| No. | −X | −R¹ | n | −R² |
|---|---|---|---|---|
| 37 | 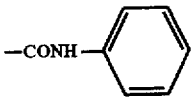 | 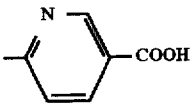 | 0 | 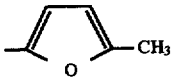 |
| 38 | $-COOC_2H_5$ | 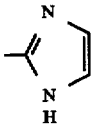 | 0 | 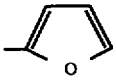 |
| 39 | −CN | 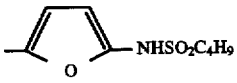 | 0 | 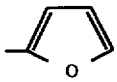 |
| 40 | $-COOC_2H_5$ | 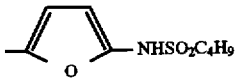 | 0 | 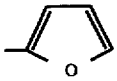 |
| 41 | $-COOC_2H_5$ | 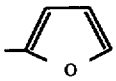 | 0 | 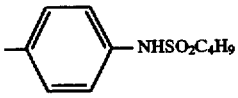 |
| 42 | 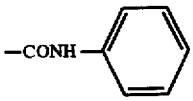 | 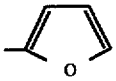 | 0 | 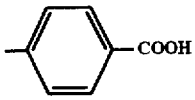 |
| 43 | $-CON(C_3H_7)_2$ | 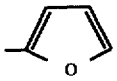 | 0 | 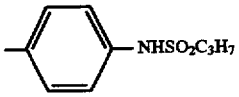 |
| 44 | $-COOC_2H_5$ | 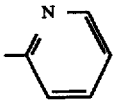 | 0 | 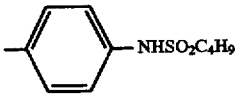 |
| 45 | −CN | 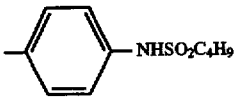 | 1 | 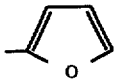 |
| 46 | −CN | 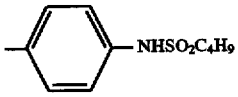 | 2 | 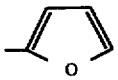 |
| 47 | −CN | 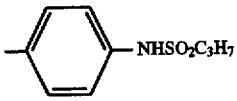 | 1 | 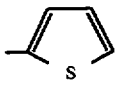 |
| 48 | $-COOC_2H_5$ | 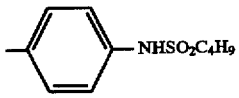 | 1 | 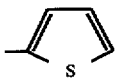 |
| 49 | $-COOC_2H_5$ | 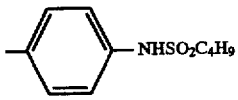 | 2 | 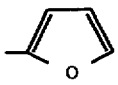 |

-continued
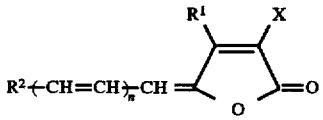
| No. | −X | −R¹ | n | −R² |
|---|---|---|---|---|
| 50 | $-COOC_2H_5$ | 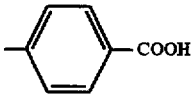 | 1 | 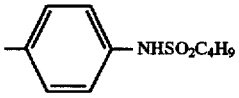 |
| 51 | $-COOC_2H_5$ | 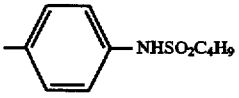 | 1 | 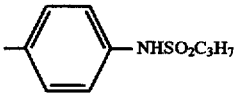 |
| 52 | −CN | 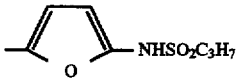 | 1 | 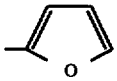 |
| 53 | −CN | 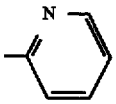 | 1 | 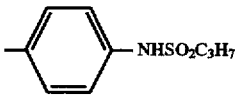 |
| 54 | −CN | 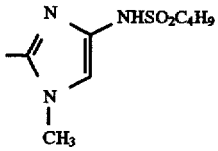 | 2 | 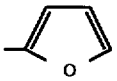 |
| 55 | −CN | $-C_{10}H_{21}$ | 0 | 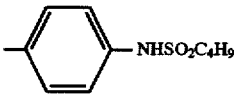 |
| 56 | $-COOCH_2NHSO_2C_4H_9$ | $-C_{10}H_{21}$ | 0 | 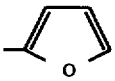 |
| 57 | −CN | 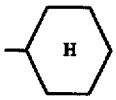 | 0 | 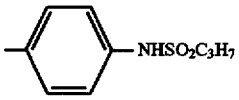 |
| 58 | 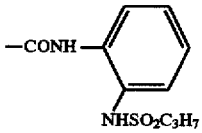 | $-C_3H_7$ | 0 | 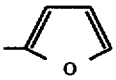 |
| 59 | −CN | $-CH_2-CH=CH_2$ | 0 | 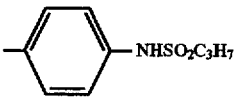 |
| 60 | −CN | $-CH_2-C\equiv CH$ | 0 | 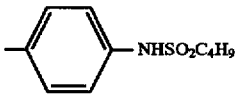 |
| 61 | $-CF_3$ | 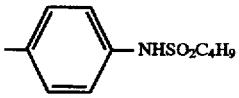 | 0 | 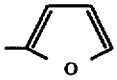 |
| 62 | $-CF_3$ | 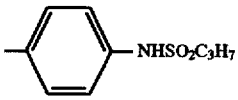 | 1 | 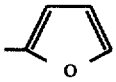 |

Dyes of formula (I) can be readily prepared by a known synthesis method described in U.S. Pat No. 3,661,899.

Tabular silver halide grains (hereinafter, denoted simply as tabular grains) used in the invention are those having two parallel major faces and an aspect ratio of circle equivalent diameter of the major face (i.e., a diameter of a circle having an area equivalent to the major face) to grain thickness (i.e., a distance between the major faces) of two or more.

Not less than 50% of the projected area of total grains are accounted for by tabular grains having preferably an average aspect ratio of 3 or more, more preferably, 5 to 8.

The average diameter of the tabular grains is within a range of 0.3 to 10 μm, preferably, 0.5 to 5.0 μm, more preferably, 0.5 to 2.0 μm. The average grain thickness is preferably 0.05 to 0.8 μm.

An average cube-equivalent edge length of the tabular grains used in the invention is, preferably, 0.5 μm more. The term, "cube-equivalent edge length" refers to an edge length of a cube having a volume equivalent to that of the tabular grain.

The diameter and thickness of the tabular grains can be determined according to the method described in U.S. Pat. No. 4,434,226.

With regard to the grain size disribution of the tabular grains, a coefficient of variation of the circle equivalent diameter of the major face, which is a standard deviation of the grain diameter divided by an average diameter, is preferably 30% or less, more preferably, 20% or less.

Photosensitive silver halide grains of the invention are preferably silver iodobromide or silver chloroiodobromide. These grains have preferably a silver iodide content of 1 to 15 mol %, more preferably, 3 to 10 mol %.

With regard to the fluctuation of the silver iodide content among grains, a variation coefficient of the silver iodide content (i.e., a standard deviation of the silver iodide content divided by an average silver iodide content) is preferably 30% or less, more preferably, 20% or less.

The tabular grains relating to the invention each comprise at least two silver halide phases which are different in the silver iodide content from each other. Among these phases, a phase having a maximum silver iodide content contains preferably silver iodide of not less than 5 mol % and less than 15 mol % of silver iodide and more preferably 5 to 8 mol %.

The maximum silver iodide containing phase accounts for, preferably 30 to 90% (more preferably 30 to 60%) of the grain volume. An outer phase which is adjacent to the phase having the maximum silver iodide content contains preferably silver iodide of 0 to 8 mol % of silver iodide, more preferably, 2 to 5 mol %.

This adjacent outer phase, which has a lower silver iodide content must not cover completely the maximum silver iodide-containing phase.

The structure regarding the halide composition can be determined by X-ray diffraction method and EPMA method The surface of tabular grains may have a silver iodide content higher than that of the maximum iodide containing phase. The surface silver iodide content is a value measured by a XPS method or ISS method.

In the case when measured by a XPS method, the surface silver iodide content is preferably 0 to 12 mol %, more preferably, 5 to 10 mol %.

The suface silver iodide content can be determined by the XPS method in the following manner. A sample is cooled down to −115° C. or lower under a super high vaccum of $1\times10^{-8}$ torr or less, exposed to X-ray of Mg-Kα line generated at a X-ray source voltage of 15 kV and X-ray source current of 40 mA and measured with respect to Ag3d5/2, Br3d and I3d3/2 electrons. From integrated intensities of peaks measured which has been corrected with a sensitivity factor, the halide composition of the surface can be determined.

The maximum iodide containing phase within the tabular grain does not include a high iodide-localized region formed by a treatment which is carried out for the purpose of forming dislocation lines, as described later.

Tabular grains relating to the invention can be prepared by combining optimally methods known in the art. There can be referred, for example, known methods described in JP-A 61-6643 (1986), 61-146305 (1986), 62-157024 (1987), 62-18556 (1987), 63-92942 (1988), 63-151618 (1988), 63-163451 (1988), 63-220238 (1988) and 63-311244 (1988). There can be employed a simultaneous mixing method, double jet method, controlled double jet method in which the pAg of a reaction mixture solution is maintained at a given value during the course of forming silver halide grains and a triple jet method in which soluble silver halided different in the halide composition are independently added. Normal precipitation or reverse precipitation in which silver halide grains are formed in the presence of silver ions in excess may be employed.

There may be optionally employed a silver halide solvent. As silver halide solvent often used are cited ammonia, thioethers and thioureas. With regard to thioethers, there can be referred U.S. Pat. Nos. 3,271,157, 3,790,387 and 3,574,628. Further, neutral method without the use of ammonia, acid method and ammoniacal method may be employed. In view of the prevention of fogging silver halide grains, the pH is preferably 5.5 or less, more preferably, 4.5 or less.

Silver halide grains may contain iodide. In this case, there is no limitation with regard to the addition method of iodide ions. The iodide ions may be added in the form of an ionic solution such as an aqueous potassium iodide solution or in the form of silver iodide fine grains.

Silver halide grains can be grown using silver halide fine grains, as disclosed in JP-A 1-183417 (1989) and 1-183645 (1989). There may be employed two or more kinds of silver halide fine grains, at least one of which contains one kind of halide, as disclosed in JP-A 5-5966 (1993).

As disclosed in JP-A 2-167537 (1990), silver halide grains can be grown, at a time during the course of grain growth, in the presence of silver halide grains having a solubility product less than that of the growing grains. The silver halide grains having less solubility product are preferably silver iodide.

In the present invention, silver halide grains preferably have dislocation lines within the grain.

The dislocation lines in tabular grains can be directly observed by means of transmision electron microscopy at a low temperature, for example, in accordance with methods described in J. F. Hamilton, Phot. Sci. Eng. 11 (1967) 57 and T. Shiozawa, J. Sci. Phot. Sci. Japan, 35 (1972) 213.

Silver halide tabular grains are taken out from an emulsion while making sure not to exert any pressure that causes dislocation in the grains, and they are placed on a mesh for electron microscopy. The sample is observed by transmission electron microscopy, while being cooled to prevent the grain from being damaged e.g., printing-out) by electron beam. Since electron beam penetration is hampered as the grain thickness increases, sharper observations are obtained when using an electron microscope of high voltage type (over 200 KV for 0.25 μm thich grains). From the thus-obtained electron micrograph the position and number of the dislocation lines in each grain can be determined in the case when being viewed from the direction perpendicular to the major face.

With respect to the position of the dislocation lines in the tabular grains relating to the present invention, it is preferable that the dislocation lines exist in a fringe portion of the major face and an inner portion thereof.

The term, "fringe portion" refers to a peripheral portion in the major face of the tabular grain. More specifically, when a straight line is drawn outwardly from the gravity center of the projection area projected from the major face-side, the dislocation lines exist in a region outer than 50% of the distance (L) between the intersection of the straight line with the outer periphery and the center, preferably, 70% or outer and more preferably 80% or outer. (In other words, the dislocation lines are located in the region between 0.5 L and L outwardly from the center of each grain, preferably between 0.7 L and L, more preferably between 0.8 L and L.)

The term, "dislocation lines which exist in the inner portion" refer to those which exist in the region other than the fringe portion above-described.

With regard to the number of dislocation lines in the tabular grains relating to the present invention, tabular grains having dislocation lines of 5 or more per grain account for, preferably, not less than 50% (by number) of the total number of silver halide grains, more preferably not less than 50%, and furthermore preferably 80%. The number of the dislocation lines is preferably 10 or more per grain.

In the case when the dislocation lines exist both in the fringe portion and in the inner portion, it is preferable that 5 or more dislocations are present in the inner portion of the grain. More preferably, 5 or more dislocation lines are both in the fringe portion and in the inner portions.

With regard to a method for introducing the dislocation lines into the silver halide grain, there is specifically no limitation. The dislocation lines can be introduced, for example, as follows. At a desired position of introducing the dislocation lines during the course of forming silver halide grains, an aqeous iodide (e.g., potassium iodide) solution is added, along with a silver salt (e.g., silver nitrate) solution and without addition a halide other than iodide, at a pAg of 11.0 or less by a double jet, silver iodide fine grains are added, only an iodide solution is added, or a compound capable of releasing an iodide ion disclosed in JP-A 6-11781 (1994) is employed. Among these, it is preferable to add iodide and silver salt solutions by double jet, or to add silver iodide fine grains or an iodide ion releasing compound, as an iodide sourse. It is more preferable to use silver iodide fine grains.

With regard to the position of the dislocation lines, it is preferable to introduce the dislocation lines after forming the maximum iodide containing silver halide phase. Specifically, the dislocation lines are introduced at a time after 50% (preferably 60%) of the total silver salt is added and before 95% (preferably 80%) of the total silver salt is added, during the course of forming silver halide grains used in the invention.

A silver halide emulsion of the present invention contains preferably N-containing heterocyclic compound represented by the following formula (II).

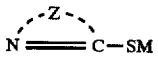

Formula (II)

In the formula, Z represents an atomic group necessary to form 5 or 6-membered heterocyclic ring, which may be condensed with another aromAtic or heterocyclic ring; M represents a hydrogen atom, alkali metal atom or ammonium group.

The 5 or 6-membered heterocyclic ring formed by Z includes imidazole, triazole, thiazole, oxazole, selenazole, benzoimidazole, naphthoimidazole, benzothiazole, naphthothiazole, benzselenazole, pyridine, pyrimidine and quinoline. These heterocyclic ring may be substituted.

Exemplary examples of the compound represented by formula (II) {hereinafter, denoted as compound (II)} are shown below.

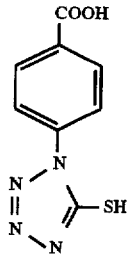

II-1

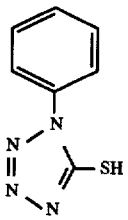

II-2

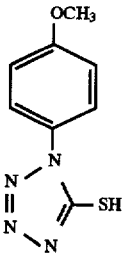

II-3

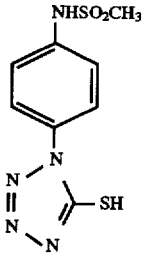

II-4

-continued

II-5

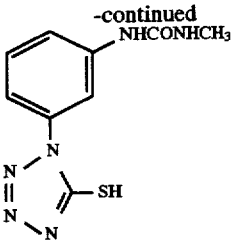

II-6

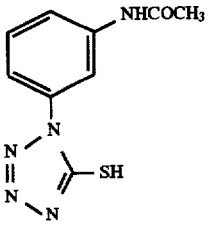

II-7

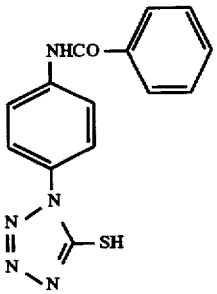

II-8

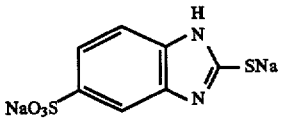

II-9

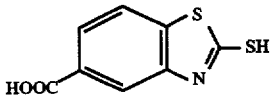

II-10

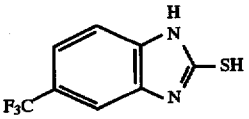

II-11

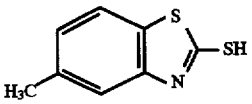

II-12

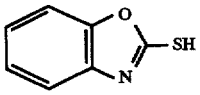

II-13

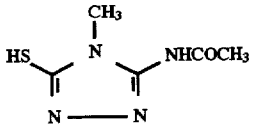

II-14

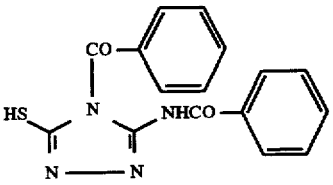

-continued

II-15

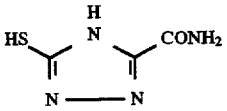

II-16

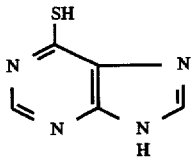

II-17

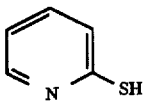

II-18

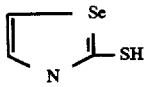

II-19

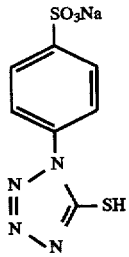

The compound (II) is added to a silver halide emulsion during chemical ripening, or at a time after chemical ripening and before coating. The compound (II) may be added dividedly. The compound (II) is added in an amount of $1\times10^{-9}$ to $1\times10^{-1}$, preferably $1\times10^{-7}$ to $1\times10^{-3}$ mol per mol of silver halide.

With regard to a silver halide emulsion, there is referred items described in Research Disclosure 308119, as shown below.

| Item | Page |
|---|---|
| Iodide system | 993, I-A |
| Preparation method | 993, I-A |
| | 994, E |
| Crystal habit (regular crystal) | " |
| Crystal habit (twinned crystal) | " |
| Epitaxial | " |
| Halide composition (uniform) | 993, I-B |
| Halide composition (nonuniform) | " |
| Halide conversion | 994, I-C |
| Halide substitution | " |
| Metal doping | 994, I-D |
| Monodispersity | 995, I-F |
| Solvent | " |
| Latent image forming position (surface) | 995, I-G |
| Latent image forming position (internal) | " |
| Negative-working material | 995, I-H |
| Positive-working material | 995, I-H |
| Blended emulsion | 995, I-J |
| Desalting | 995, II-A |

A silver halide emulsion of the invention may be subjected to physical ripening, chemical ripening or spectral sensitization. Additives used in these processes are described in Research Disclosure Nos. 17643, 18716 and 308119 (hereinafter, denoted as RD 17643, 18716 and 308119), as shown below.

| Item | RD 308119 | RD 17643 | RD 18716 |
|---|---|---|---|
| Chemical sensitizer | 996 III-A | 23 | 648 |
| Spectral sensitizer | 996 IV-A-A, B, C D, H, I, J | 23–24 | 648–9 |
| Super sensitizer | 996 IV-A-E, J | 23–24 | 648–9 |
| Fog inhibitor | 998 VI | 24–25 | 649 |
| Stabilizer | 998 VI | 24–25 | 649 |

Further, additives which can be employed in the present invention are also described in the Research Disclosures as shown below.

| Item | RD 308119 | RD 17643 | RD 18716 |
|---|---|---|---|
| Antistain agent | 1002 VII-I | 25 | 650 |
| Dye image stabilizer | 1001 VII-J | 25 | |
| Brightener | 998 V | 24 | |
| UV absorbent | 1003 VIII-C | 25–26 | |
| Light absorbing agent | " | 25–26 | |
| Light scattering agent | " | | |
| Filter dye | " | | |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | " | 27 | 650 |
| Surfactant, coating aid | 1005 XI | 26–27 | 650 |
| Matting agent | 1007 XVI | | |
| Developer-in-emulsion | 1011 XX-B | | |

In the present invention, various kinds of couplers can be employed, examples of which are shown below.

| Item | | |
|---|---|---|
| Yellow coupler | 1001 VII-D | VII C-G |
| Magenta coupler | " | " |
| Cyan coupler | " | " |
| Colored coupler | 1002 VII-G | VII G |
| DIR coupler | 1001 VII-F | VII F |
| BAR coupler | 1002 VII-F | |
| PUG-releasing coupler | 1001 VII-F | |
| Alkali-soluble coupler | 1001 VII-E | |

The additives usable in the present invention may be added according to a dispersing method described in RD 308119.

In the invention, there can be employed supports described in RD 17643 page 28, RD 18716 pages 647-8, RD 308119.

The photographic light sensitive material of the invention may be provided with a filter layer or interlayer, as described in RD 308119-K.

The photographic light sensitive material of the invention may have any layer structure such as normal layer structure, inverted layer structure or unit layer structure, as described in RD 308119-K The photographic light sensitive material of the invention are applicable to various type color photographic materials including a color negative film for general use or movie, color reversal film for slide or television, color paper, color positive film and color reversal paper.

The photographic material of the invention can be processed in a conventional manner described in RD17643 page 28–29, RD18716 page 647 and RD 308119.

EXAMPLES

Example 1

Preparation of Seed Emulsion-1

Using a mixing stirrer described in Japanese Patent examined Nos. 58-58288 and 58-58289, an aqueous silver nitrate solution (1.161 mol) and an aqueous solution of potassium bromide and potassium iodide (potassium iodide, 2 mol %) were added to solution A1 maintained at 35° C. over a period of 2 min. by a double jet method to form nucleuses, while being kept at a silver potential of 0 mV (measured with a silver ion selection electrode with reference to saturated silver-silver chloride electrode). Subsequently, the temperature was increased to 60° C. taking 60 min. After the pH was adjusted to 5.0 with an aqueous sodium carbonate solution, an aqueous silver nitrate solution (5.902 mol) and an aqueous solution of potassium bromide and potassium iodide (potassium iodide, 2 mol %) were added thereto over a period of 42 min. by a double jet method, while being kept at a silver potential of 9 mV. After completing the addition, the temperature was lowered to 40° C. and desalting was carried out by a conventional flocculation.

The thus-prepared seed crystal grain emulsion was comprised of silver halide grains having an average grain size (sphere-equivalent diameter) of 0.24 μm and an average aspect ratio of 4.8, not less than 90% of the projected area of total grains being accounted for by hexagonal tabular grains having a maximum edge ratio of 1.0 to 2.0. This emulsion was denoted as Seed emulsion-1.

| Solution A1: | |
|---|---|
| Ossein gelatin | 24.2 g |
| Potassium bromide | 10.8 g |
| Polypropyleneoxy-polyethyleneoxydi-succinate, sodium salt (10% ethanol soln.) | 6.78 ml |
| 10% Nitric acid | 114 ml |
| Water | 9657 ml |

Preparation of silver iodide fine grain emulsion SMC-1

To 5 liters of a 6.0 wt % gelatin aqueous solution containing 0.06 mol of potassium iodide, an aqueous silver nitrate solution (7.06 mol) and an aqueous possium iodide solution (7.06 mol), each 2 liters was added with vigorously stirring over a period of 10 min., while the pH was controlled at 2.0 with nitric acid and the temperature was kept at 40° C. After completing the grain formation, the pH was adjusted to 5.0 using an aqueous solution of sodium carbonate. The resulting emulsion was comprised of silver iodide fine grains having an average size of 0.05 μm. This emulsion was denoted SMC-1.

Preparation of inventive emulsion Em-1

700 ml of a 4.5 wt % inert gelatin aqueous solution containing 0.178 mol equivalent Seed emulsion-1 and 0.5 ml of a 10% polyisoprene-polyethyleneoxy-disuccinate ethanol solution was maintained at 75° C., and after the pAg and pH were adjusted to 8.3 and 5.0, grain formation was carried out with sirring by a double jet method according to the following sequence.

1) An aqueous silver nitrate solution (2.121 mol), 0.174 mol of SMC-1 and an aqueous potassium bromide solution were added, while being kept at a pAg of 8.3 and pH of 5.0. (Formation of host grains).

2) Subsequently, the temperature of the solution was lowered to 60° C. and the pAg was adjusted to 9.6. Then, 0.071 mol of SMC-1 was added thereto and ripening was carried out further for 2 min. (Introduction of dislocation lines).

3) An aqueous silver nitrate solution (0.959 mol), 0.030 mol of SMC-1 and an aqueous potassium bromide solution were added, while being kept at a pAg of 9.6 and pH of 5.0. (Shell formation of host grains).

During the course of grain formation, each solution was added at a optimal flowing rate not so as to form new nuclear grains and cause Ostwald ripening. After completing the addition, desalting was carried out by a conventional flocculation method and after adding gelatin thereto, the pAg and pH were each adjusted to 8.1 and 5.8.

The resulting emulsion was shown to be comprised of tabular grains having an average cube-equivalent edge length of 0.65 μm and an average aspect ratio of 4.1. It was further shown that the tabular grains had, within the grain, silver halide phases different in the silver iodide content from each other, in which a maximum iodide containing phase and a phase adjacent thereto contained silver iodide of 10.and 7 mol %, respectively. According to the electron micrograph, there was observed not less than 80% (by number) of the grains, each having 5 or more dislocation lines in each of the fringe portion and inner portion thereof.

Preparation of inventive emulsion Em-2

A silver halide emulsion Em-2 was prepared in the same manner as in Em-1, except that the pAg at the step of the host grain formation was changed to 8.6, and the pAg at the steps of the introduction of the dislocation lines and the shell formation was change to 9.4.

The resulting emulsion was shown to be comprised of tabular grains having an average cube-equivalent edge length of 0.35 μm and an average aspect ratio of 6.6. It was further shown that the tabular grains had, within the grain, silver halide phases different in the silver iodide content from each other, in which a maximum iodide containing phase and a phase adjacent thereto contained silver iodide of 8.and 6 mol %, respectively. According to the electron micrograph, there was observed not less than 80% (by number) of the grains, each having 5 or more dislocation lines in each of the fringe portion and inner portion thereof.

Preparation of inventive emulsion Em-3

A silver halide emulsion was prepared in the same manner as in Em-2, except that at, the step of the host grain formation, the silver nitration solution and SMC-1 were changed to 2.093 mol and 0.202 mol, respectively.

The resulting emulsion was shown to be comprised of tabular grains having an average cube-equivalent edge length of 0.35 μm and an average aspect ratio of 6.5. It was further shown that the tabular grains had, within the grain, silver halide phases different in the silver iodide content from each other, in which a maximum iodide containing phase and a phase adjacent thereto contained silver iodide of 9.and 7 mol %, respectively. According to the electron micrograph, there was observed not less than 80% (by number) of the grains, each having 5 or more dislocation lines in each of the fringe portion and inner portion thereof.

Preparation of inventive emulsion Em-4

A silver halide emulsion was prepared in the same manner as in Em-1, except that, at the step of the host grain formation, the silver nitrate solution and SMC-1 were changed to 2.066 mol and 0.230 mol, respectively.

The resulting emulsion was shown to be comprised of tabular grains having an average cube-equivalent edge length of 0.65 μm and an average aspect ratio of 4.0. It was further shown that the tabular grains had, within the grain, silver halide phases different in the silver iodide content from each other, in which a maximum iodide containing phase and a phase adjacent thereto contained silver iodide of 13.and 10 mol %, respectively. According to the electron micrograph, there was observed not less than 80% (by number) of the grains, each having 5 or more dislocation lines in each of the fringe portion and inner portion thereof.

After potassium thiocyanate ($9.9\times10^{-4}$ mol/mol AgX) was added to each of emulsions Em-1 to 4, sensitizing dyes SD-6, SD-7 and SD-8 as shown below were added thereto and then were further added a compound (II) and sensitizer as shown in Table 1. Subsequently, thiosulfate ($4.17\times10^{-6}$ mol/mol AgX) and chloroauric acid ($2.3\times10^{-6}$ mol/mol AgX) was added to each emulsion and chemical sensitization was optimally carried out according to the conventional manner.

To each emulsion were added a stabilizer (ST-1) and fog restrainer (AF-1) in an amount of 500 mg and 10 mg per mol of silver halide, respectively.

There were prepared photographic light sensitive material samples 101 to 113 having the follwing layer structure, in which silver halide emulsions prepared as above were employed in the 9th layer and a compound of formula (I) replaced yellow colloidal silver used in the 10th layer. The coating amount of silver halide or colloidal silver was converted to silver, being expressed in g per $m^2$ of the photographic material. It was expressed in $g/m^2$ for couplers and aditives. With respect to a sensitizing dye, it was expressed in mol per mol of silver halide contained in the same layer.

| | |
|---|---|
| 1st layer; Antihalation layer | |
| Black colloidal silver | 0.16 |
| UV absorbent (UV-1) | 0.20 |
| High boiling solvent (OIL-1) | 0.16 |
| Gelatin | 1.23 |
| 2nd layer; Interlayer | |
| High boiling solvent (OIL-2) | 0.17 |
| Gelatin | 1.27 |
| 3rd layer; Low speed red-sensitive layer | |
| Silver iodobromide emulsion (Av. grain size of 0.38 μm, 7 mol % iodide) | 0.50 |
| Silver iodobromide emulsion (Av. grain size of 0.27 μm, 2 mol % iodide) | 0.21 |
| Sensitizing dye (SD-1) | $2.8\times10^{-4}$ |
| Sensitizing dye (SD-2) | $1.9\times10^{-4}$ |
| Sensitizing dye (SD-3) | $1.9\times10^{-5}$ |
| Sensitizing dye (SD-4) | $1.0\times10^{-4}$ |
| Cyan coupler (C-1) | 0.48 |
| Cyan coupler (C-2) | 0.14 |
| Colored cyan coupler (CC-1) | 0.021 |
| DIR compound (D-1) | 0.020 |
| High boiling solvent (OIL-1) | 0.53 |
| Gelatin | 1.30 |
| 4th layer; Medium speed red-sensitive layer | |
| Silver iodobromide emulsion (Av. grain size of 0.65 μm, 8 mol % iodide) | 0.62 |
| Silver iodobromide emulsion (Av. grain size of 0.38 μm, 7 mol % iodide) | 0.27 |
| Sensitizing dye (SD-1) | $2.3\times10^{-4}$ |
| Sensitizing dye (SD-2) | $1.2\times10^{-4}$ |
| Sensitizing dye (SD-3) | $1.6\times10^{-5}$ |
| Sensitizing dye (SD-4) | $1.2\times10^{-4}$ |
| Cyan coupler (C-1) | 0.15 |
| Cyan coupler (C-2) | 0.18 |
| Colored cyan coupler (CC-1) | 0.030 |
| DIR compound (D-1) | 0.013 |
| High boiling solvent (OIL-1) | 0.30 |
| Gelatin | 0.93 |
| 5th layer; High speed red-sensitive layer | |
| Silver iodobromide emulsion (Av. grain size of 0.90 μm, 8 mol % iodide) | 1.27 |
| Sensitizing dye (SD-1) | $1.3\times10^{-4}$ |

-continued

| | |
|---|---|
| Sensitizing dye (SD-2) | $1.3 \times 10^{-4}$ |
| Sensitizing dye (SD-3) | $1.6 \times 10^{-5}$ |
| Cyan coupler (C-2) | 0.12 |
| Colored cyan coupler (CC-1) | 0.013 |
| High boiling solvent (OIL-1) | 0.14 |
| Gelatin | 0.91 |
| 6th layer; Interlayer | |
| High boiling solvent (OIL-2) | 0.11 |
| Gelatin | 0.80 |
| 7th layer; Low speed green-sensitive layer | |
| Silver iodobromide emulsion (Av. grain size of 0.38 μm, 8 mol % iodide) | 0.61 |
| Silver iodobromide emulsion (Av. grain size of 0.27 μm, 2 mol % iodide) | 0.20 |
| Sensitizing dye (SD-4) | $7.4 \times 10^{-5}$ |
| Sensitizing dye (SD-5) | $6.6 \times 10^{-4}$ |
| Magenta coupler (M-1) | 0.18 |
| Magenta coupler (M-2) | 0.44 |
| Colored magenta coupler (CM-1) | 0.12 |
| DIR compound (D-2) | 0.02 |
| High boiling solvent (OIL-2) | 0.75 |
| Gelatin | 1.95 |
| 8th layer; Medium speed green-sensitive layer | |
| Silver iodobromide emulsion (Av. grain size of 0.65 μm, 8 mol % iodide) | 0.87 |
| Sensitizing dye (SD-6) | $2.4 \times 10^{-4}$ |
| Sensitizing dye (SD-7) | $2.4 \times 10^{-4}$ |
| Magenta coupler (M-1) | 0.058 |
| Magenta coupler (M-2) | 0.13 |
| Colored magenta coupler (CM-1) | 0.070 |
| DIR compound (D-2) | 0.025 |
| High boiling solvent (OIL-2) | 0.50 |
| Gelatin | 1.00 |
| 9th layer; High speed green-sensitive layer | |
| Silver iodobromide emulsion (Av. grain size of 0.90 μm,8 mol % iodide) | 1.27 |
| Sensitizing dye (SD-6) | $7.0 \times 10^{-5}$ |
| Sensitizing dye (SD-7) | $7.0 \times 10^{-5}$ |
| Sensitizing dye (SD-8) | $7.1 \times 10^{-5}$ |
| Magenta coupler (M-2) | 0.084 |
| Magenta coupler (M-3) | 0.064 |
| Colored magenta coupler (CM-1) | 0.012 |
| High boiling solvent (OIL-1) | 0.27 |
| High boiling solvent (OIL-2) | 0.012 |
| Gelatin | 1.00 |
| 10th layer; Yelllow filter layer | |
| Yellow colloidal silver | 0.08 |
| Antistain agent (SC-1) | 0.15 |
| Formalin scavenger (HS-1) | 0.20 |
| High boiling solvent (OIL-1) | 0.19 |

-continued

| | |
|---|---|
| Gelatin | 1.10 |
| 11th layer; Interlayer | |
| Formalin scavenger (HS-1) | 0.20 |
| Gelatin | 0.60 |
| 12th layer; Low speed blue-sensitive layer | |
| Silver iodobromide emulsion (Av. grain size of 0.65 μm, 8 mol % iodide) | 0.07 |
| Silver iodobromide emulsion (Av. grain size of 0.38 μm, 7 mol % iodide) | 0.16 |
| Silver iodobromide emulsion (Av. grain size of 0.27 μm, 2 mol % iodide) | 0.10 |
| Sensitizing dye (SD-8) | $4.9 \times 10^{-4}$ |
| Yellow coupler (Y-1) | 0.80 |
| DIR compound (D-3) | 0.15 |
| High boiling solvent (OIL-2) | 0.30 |
| Gelatin | 1.20 |
| 13th layer; High speed blue-sensitive layer | |
| Silver iodobromide emulsion (Av. grain size of 1.00 μm, 8 mol % iodide) | 0.80 |
| Silver iodobromide emulsion (Av. grain size of 0.65 μm, 8 mol % iodide) | 0.15 |
| Sensitizing dye (SD-8) | $7.3 \times 10^{-5}$ |
| Sensitizing dye (SD-9) | $2.8 \times 10^{-5}$ |
| Yellow coupler (Y-1) | 0.15 |
| High boiling solvent (OIL-2) | 0.046 |
| Gelatin | 0.80 |
| 14th layer; First protective layer | |
| Silver iodobromide emulsion (Av. grain size of 0.08 μm, 1 mol % iodide) | 0.40 |
| UV absorbent (UV-1) | 0.065 |
| UV absorbent (UV-2) | 0.10 |
| High boiling solvent (OIL-1) | 0.07 |
| High boiling solvent (OIL-3) | 0.07 |
| Formalin scavenger (HS-1) | 0.40 |
| Gelatin | 1.31 |
| 15th layer; Second protective layer | |
| Alkali-soluble matting agent (PM-1, Av. 2 μm) | 0.15 |
| Polymethylmethaacrylate (Av. 3 μm) | 0.04 |
| Slipping agent (WAX-1) | 0.04 |
| Gelatin | 0.55 |

In addition to the above composition were added coating aids (SU-1 and 2), viscosity-adjusting agent (V-1), Hadener (H-1 and 2), stabilizer (ST-1), fog restrainer (AF-1), dye (AI-1 and 2), AF-2 comprising two kinds of weight-averaged molecular weights of 10,000 and 1.100,000 and antimold (DI-1). The addition amount of DI-1 was 9.4 g/m$^2$.

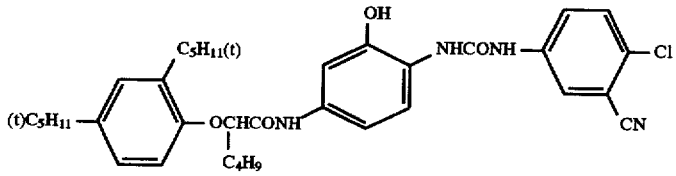

C-1

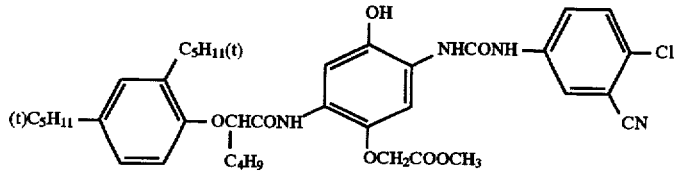

C-2

-continued
M-1
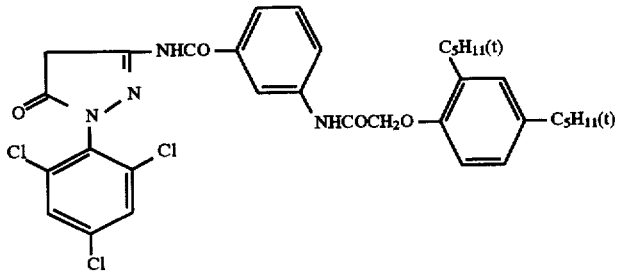
M-2
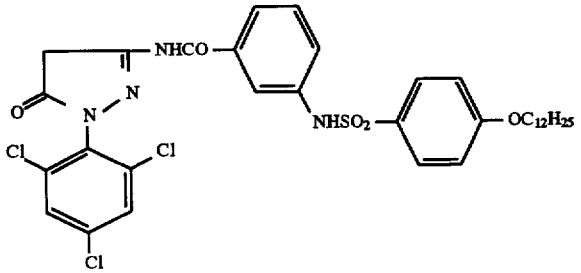
M-3
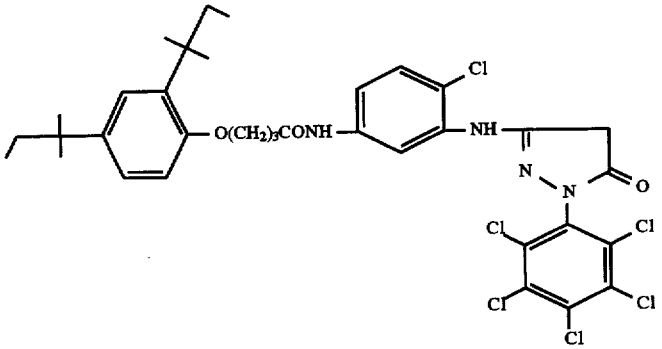
Y-1
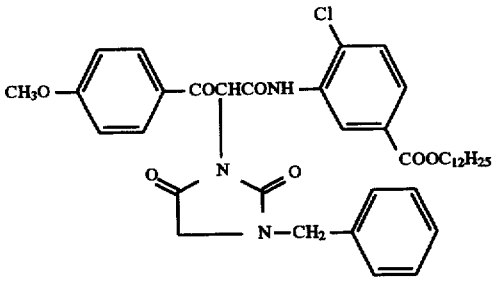
CC-1
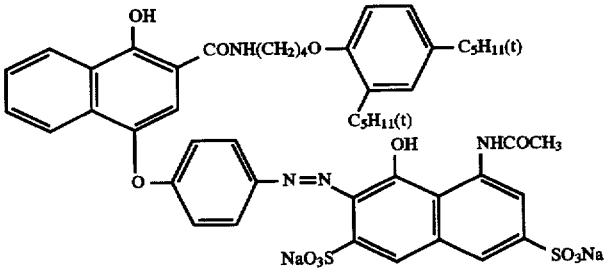

-continued
CM-1
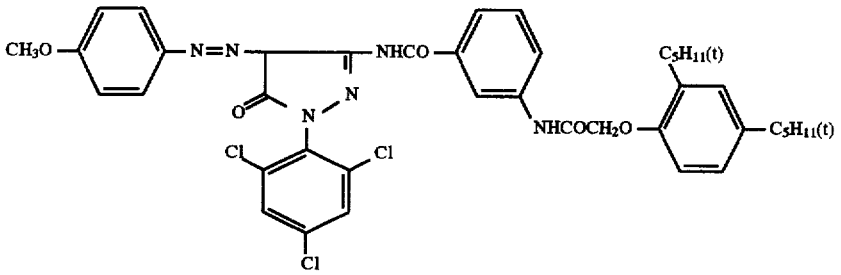
D-1
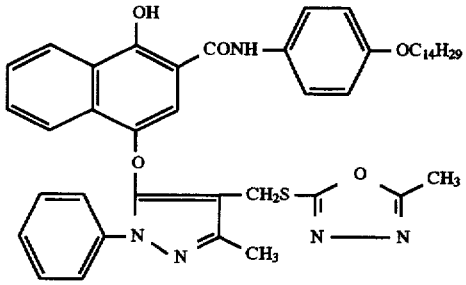
D-2
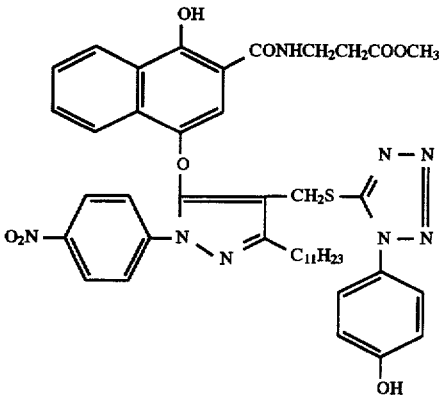
D-3
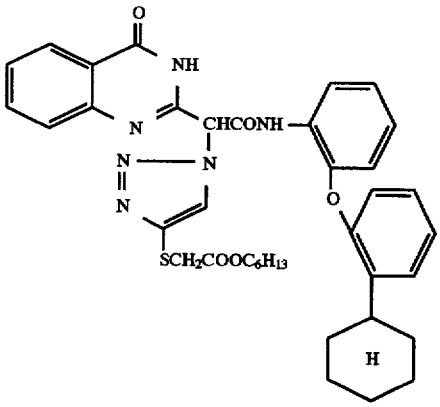
Oil-1
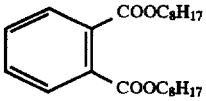
Oil-2
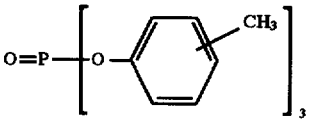
Oil-3
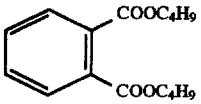
SC-1
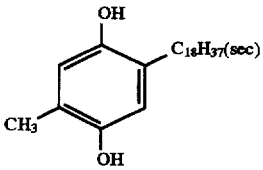
UV-1
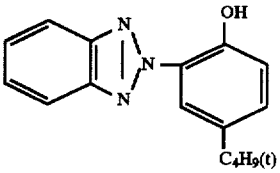
UV-2
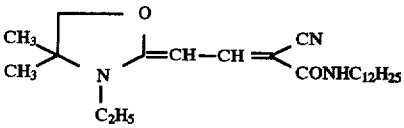
WAX-1
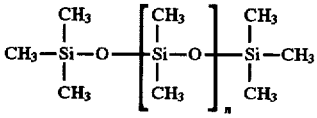
Weight-average molecular weight MW: 3,000

-continued
Su-1
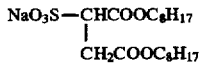
Su-2
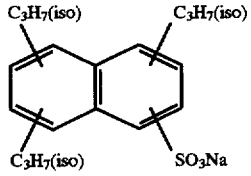
HS-1
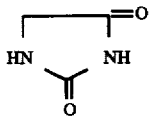
PM-1
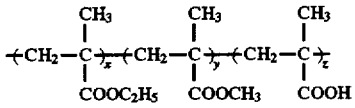
x:y:z = 3:3:4
SD-1
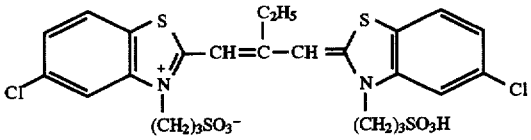
SD-2
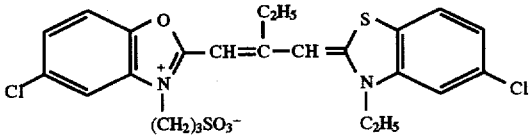
SD-3
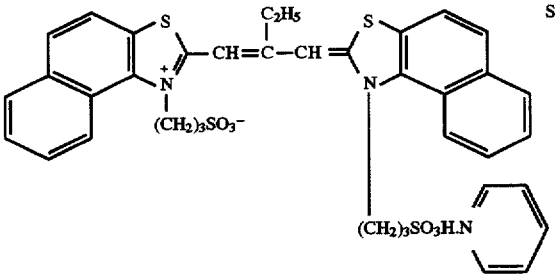
SD-4
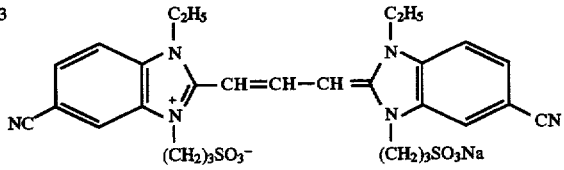
SD-5
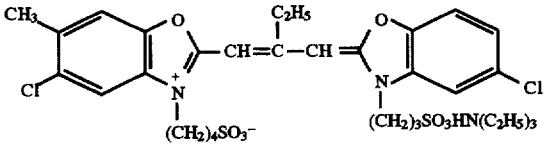
SD-6
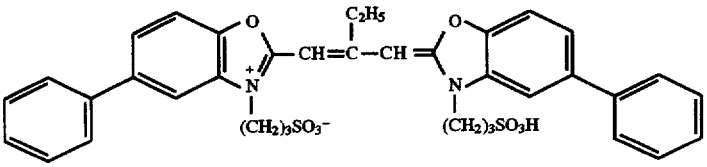
SD-7
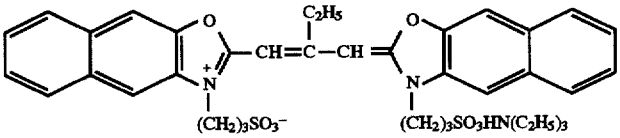
SD-8
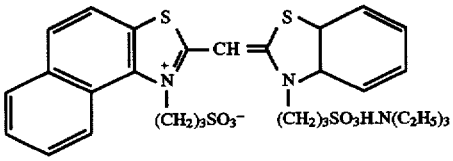
SD-9
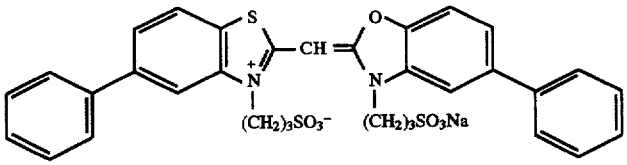

-continued

H-1

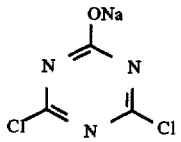

H-2

$(CH_2{=}CHSO_2CH_2)_2O$

ST-1

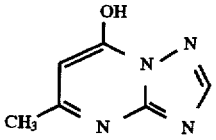

AF-1

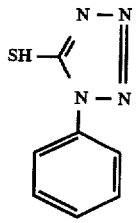

AF-2

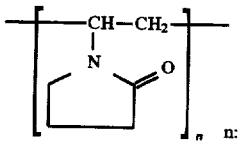

n: Polymerization degree (Mixture of A, B and C)

DI-1

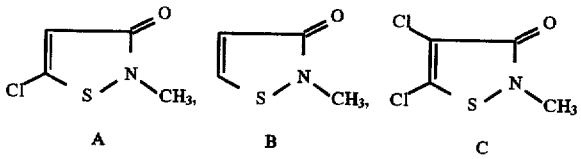

A B C

A:B:C = 50:46:4 (molar ratio)

AI-1

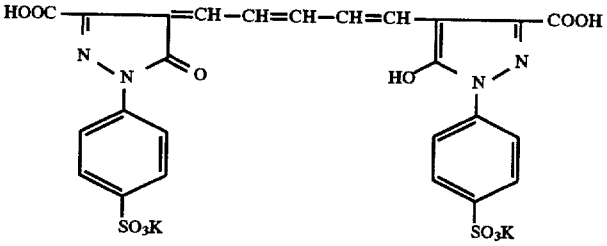

AI-2

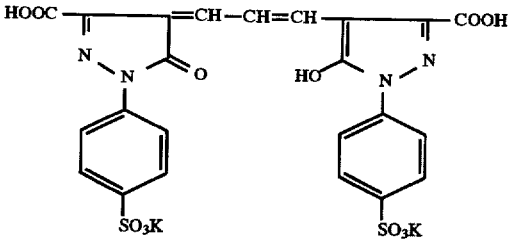

V-1

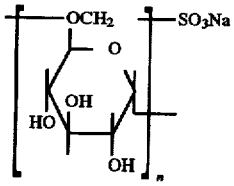

These photographic material samples were exposed through a glass filter(Y-48, product by Toshiba) using a light source having a color temperature of 5400° K. and processed according to the following procedure.

| Step | Time | Temp. | Replenisher* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 1 min. | 38 ± 5.0° C. | 830 ml |
| Drying | 1 min. | 55 ± 5.0° C. | — |

*Replenishing amount is expressed in ml per $m^2$.

A color developer, bleach, fixer and stabilizer each were prepared according to the following formulas.

Color developer and replenisher thereof:

| | Worker | Replenisher |
|---|---|---|
| Water | 800 ml | 800 ml |
| Potassium carbonate | 30 g | 35 g |
| Sodium hydrogen carbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxyamine sulfate | 2.5 g | 3.1 g |
| Sodium chloride | 0.6 g | — |

-continued

| | Worker | Replenisher |
|---|---|---|
| 4-Amino-3-methyl-N-(β-hydroxyethyl)-aniline sulfate | 4.5 g | 6.3 g |
| Diethylenetriaminepentaacetic acid | 3.0 g | 3.0 g |
| Potassium hydroxide | 1.2 g | 2.0 g |

Water was added to make 1 liter in total, and the pH of the developer and replenisher thereof were each adjusted to 10.06 and 10.18, respectively with potassium hydroxide and sulfuric acid.

Bleach and replenisher thereof:

| | Worker | Replenisher |
|---|---|---|
| Water | 700 ml | 700 ml |
| Ammonium iron (III) 1,3-diamino-propanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and replenisher thereof were adjusted to 4.4 and 4.0, respectively, with ammoniacal water or glacial acetic acid.

Fixer and replenisher thereof:

| | Worker | Replenisher |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Water was added to make 1 liter in total and the pH of the fixer and replenisher thereof were adjusted to 6.2 and 6.5, respectively, with ammoniacal water or glacial acetic acid.

Stabilizer and replenisher thereof:

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

In order to make evaluation with respect to storage stability, photographic material samples were allowed to stand under the condition of 23° C. and 55% RH over a period of 24 hrs. and thereafter were further aged under the condition of 50° C. and 70% RH for 7 days.

Photographic sensitivity was shown as a relative value of a reciprocal of an exposure amount necessary to give a density of fog +0.1, based on the sensitivity of Sample 101 being 100. results thereof are shown in Table 1, in which emulsions Em-1 and 4 were used.

TABLE 1

| Sample | | Sensitizer | | Compd. | Compd. (II) | | Fresh sample | | Aged sample | | |
|---|---|---|---|---|---|---|---|---|---|---|---|
| No. | Emulsion | | (mol/Ag mol) | (I) | | (mol/Ag mol) | Sensitivity | Fog | Sensitivity | Fog | Remarks |
| 101 | Em-4 | | — | — | | — | 100 | 0.20 | 80 | 0.30 | Comp. |
| 102 | Em-1 | | — | — | | — | 105 | 0.25 | 90 | 0.35 | Comp. |
| 103 | Em-1 | TPPS | $(4.4 \times 10^{-6})$ | — | | — | 135 | 0.25 | 145 | 0.45 | Comp. |
| 104 | Em-4 | TPPS | $(4.4 \times 10^{-6})$ | — | | — | 120 | 0.25 | 130 | 0.40 | Comp. |
| 105 | Em-1 | TPPS | $(4.4 \times 10^{-6})$ | — | II-1 | $(1.0 \times 10^{-4})$ | 133 | 0.23 | 123 | 0.32 | Comp. |
| 106 | Em-1 | TPPS | $(4.4 \times 10^{-6})$ | 2 | | — | 135 | 0.25 | 140 | 0.25 | Inv. |
| 107 | Em-1 | DMSU | $(2.0 \times 10^{-6})$ | 2 | | — | 125 | 0.23 | 115 | 0.27 | Inv. |
| 108 | Em-4 | TPPS | $(4.4 \times 10^{-6})$ | 2 | | — | 120 | 0.25 | 115 | 0.28 | Inv. |
| 109 | Em-1 | TEPT | $(7.2 \times 10^{-6})$ | 4 | | — | 115 | 0.23 | 105 | 0.28 | Inv. |
| 110 | Em-1 | TPPS | $(4.4 \times 10^{-6})$ | 2 | II-1 | $(1.0 \times 10^{-4})$ | 135 | 0.10 | 136 | 0.10 | Inv. |
| 111 | Em-4 | TPS | $(5.0 \times 10^{-6})$ | 2 | II-1 | $(1.0 \times 10^{-4})$ | 120 | 0.10 | 117 | 0.12 | Inv. |
| 112 | Em-1 | DMSU | $(2.0 \times 10^{-4})$ | 4 | II-5 | $(1.5 \times 10^{-4})$ | 125 | 0.13 | 127 | 0.13 | Inv. |
| 113 | Em-1 | TEPS | $(7.2 \times 10^{-6})$ | 6 | II-5 | $(1.5 \times 10^{-4})$ | 130 | 0.10 | 131 | 0.11 | Inv. |

1) Addition amount of compound (I) of 0.35 g/m$^2$
2) TPPS: Triphenylphosphinselenide
DMSU: Dimethylselenourea
TEPT: Triethylphosphintelluride
TPS: Triphosphinselenide From the foregoing results, it is shown that samples 106 to 109 containing inventive compounds (I) were each less in fog increase due to storage, but slightly larger in sensitivity variation. It is noted that samples 110 to 113 containing further inventive compounds (II) achieved further improved storage stability in sensitivity and fog.

Example 2

After adenine ($6.7\times10^{-5}$ mol/Ag mol) was added to emulsions Em-2 and 3 kept at 52° C., a sensitizing dye SD-8 was added thereto and then a sensitizer as shown in Table 2 was added. Subsequently, each of the emulsions was chemically sensitized by adding sodium thiosulfate ($6.7\times10^{-6}$ mol/Ag mol), chloroauric acid ($3.7\times10^{-6}$ mol/Ag mol) and potassium thiocyanate ($5.0\times10^{-4}$ mol/Ag mol) optimally according to the conventional manner.

After ripening, a stabilizer (ST-1) and fog restrainer (AF-1) were added to each emulsion in amounts of 300 mg and 5 mg per mol of silver halide, respectively.

Using these emulsions, multilayered photographic material samples 201 to 209 were prepared in a manner similar to Example 1, provided that the layer constitution was varied as shown in Table 2.

TABLE 2

| Sample No. | 12th layer Emulsion | Sensitizer (mol/Ag mol) | | Compd. (II) (mol/Ag mol) | | 9th layer | 10th layer | Remark |
|---|---|---|---|---|---|---|---|---|
| 201 | Em-3 | — | | — | | * | * | Comp. |
| 202 | Em-2 | — | | — | | * | * | Comp. |
| 203 | Em-2 | TPPS | $(5.4 \times 10^{-6})$ | — | | * | * | Comp. |
| 204 | Em-2 | TPPT | $(8.2 \times 10^{-6})$ | II-6 | $(5.0 \times 10^{-5})$ | * | * | Comp. |
| 205 | Em-3 | TPPS | $(5.4 \times 10^{-6})$ | — | | ** | * | Comp. |
| 206 | Em-3 | TPPS | $(5.4 \times 10^{-6})$ | II-1 | $(1.0 \times 10^{-4})$ | ** | * | Comp. |
| 207 | Em-2 | TPPS | $(5.4 \times 10^{-6})$ | II-1 | $(1.0 \times 10^{-4})$ | ** | ** | Inv. |
| 208 | Em-2 | DSU | $(3.0 \times 10^{-6})$ | II-13 | $(2.0 \times 10^{-6})$ | ** | ** | Inv. |
| 209 | Em-2 | TPPT | $(8.2 \times 10^{-6})$ | II-19 | $(1.0 \times 10^{-4})$ | ** | ** | Inv. |
| | | | | II-13 | $(2.0 \times 10^{-5})$ | | | |

*: The same as in Sample 101 of Example 1
**: The same as in Sample 111 of Example 1
TPPT: Triphenylphosphinetelluride Using the same processing solutions as in Example 1, samples were evaluated with respecto to processing stability. Samples were processed with a fresh developer or running developer after two-round (hereinafterm denoted as 2R) running-processing using an automatic processor (Konica CL-PP1771VQA). In processing with a processor, processing solutions are replenished according to the length or number of a color photographic material to be process. "One-round" is defined to be the time when the total replenishing amount of a developer reaches the total volume of a developer tank. Therefore, the term "two-round running processing" means that the above one-round processing is run twice.

Processing stabilities are shown in Table 3 with respect to the difference in fog between before and after 2R running-processing (ΔF).

TABLE 3

| Sample No. | Processing stability (ΔF) Blue sensitive layer | Green sensitive layer | Remarks |
|---|---|---|---|
| 201 | ±0.25 | ±0.35 | Comp. |
| 202 | ±0.23 | ±0.35 | Comp. |
| 203 | ±0.35 | ±0.35 | Comp. |
| 204 | ±0.20 | ±0.35 | Comp. |
| 205 | ±0.16 | ±0.20 | Comp. |
| 206 | ±0.15 | ±0.20 | Comp. |
| 207 | ±0.03 | ±0.03 | Inv. |
| 208 | ±0.05 | ±0.05 | Inv. |
| 209 | ±0.02 | ±0.03 | Inv. |

As can be seen from the results, the use of the compound (II) resulted in an improvement in processing stability with respect to the blue-sensitive layer. It is further noted that a combined use of the compound (II) with the dye (I) employed in the 10th layer achieved unexpectedly remarkable improvements, as shown in samples 207 to 209.

What is claimed is:

1. A silver halide color photographic light sensitive material comprising a support having thereon hydrophilic colloid layers including a silver halide emulsion layer, wherein said silver halide emulsion layer contains photosensitive silver halide grains which have been selenium-sensitized or tellurium sensitized; and at least one of the hydrophilic colloid layers contains an organic dye represented by the following formula (I),

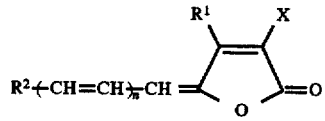

formula (I)

wherein $R^1$ and $R^2$ represent an alkyl group, alkenyl group, alkynyl group, aryl group or heterocyclic group; X represents —CN, $COOR^3$, $—CONR^3R^4$, $—SO_2NR^3R^4$, $—COR^3$, $—SO_2R^3$ or $—CF_3$, in which $R^3$ and $R^4$ represent a hydrogen atom, alkyl group, alkenyl group, alkynyl group, aryl group or heterocyclic group; n is an integer of 0, 1 or 2.

2. The silver halide color photographic material of claim 1, wherein not less than 30% by number of total silver halide grains is accounted for by tabular silver halide grains each comprising two or more silver halide phases different in a silver iodide content from each other, a maximum silver iodide containing phase having a silver iodide content of not less than 5 mol % and less than 15 mol %; and said tabular grains having 5 or more dislocation lines per grain.

3. The silver halide color photographic material of claim 2, wherein said tabular grains comprise silver iodobromide or silver iodochlorobromide, each having an average silver iodide content of 1 to 15 mol %.

4. The silver halide color photographic material of claim 1, wherein said silver halide emulsion layer contains a compound represented by the following formula (II),

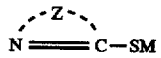

formula (II)

wherein Z represents an atomic group necessary to form a 5- or 6-membered ring and M represents a hydrogen atom, an alkali metal atom or an ammonium group.

5. A silver halide color photographic light sensitive material comprising a support having thereon hydrophilic colloid layers including a silver halide emulsion layer, wherein at least one of the hydrophilic colloid layers contains an organic dye represented by the following formula (I); and said silver halide emulsion layer contains photosensitive silver halide grains prepared by a process comprising the steps of, (i) forming silver halide grains by mixing a silver salt and a halide salt and (ii) subjecting the silver halide grains formed to chemical sensitization, wherein, in step (ii), said silver halide grains are chemically sensitized by adding a selenium compound or tellurium compound, formula (I)

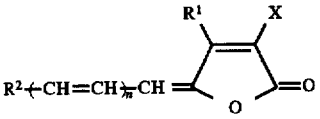

wherein $R^1$ and $R^2$ represent an alkyl group, alkenyl group, alkynyl group, aryl group or heterocyclic group; X represents —CN, $COOR^3$, $—CONR^3R^4$, $—SO_2NR^3R^4$, $—COR^3$, $—SO_2R^3$ or $—CF_3$, in which $R^3$ and $R^4$ represent a hydrogen atom, alkyl group, alkenyl group, alkynyl group, aryl group or heterocyclic group; n is an integer of 0, 1 or 2.

6. The silver halide color photographic material of claim 5, wherein said selenium compound is selected from the group consisting of elemental selenium, isoselenocyanates, selenoureas, selenoketones, selenoamides, selenocarboxylic acids and esters thereof, selenophosphates, and selenides.

7. The silver halide color photographic material of claim 5, wherein said tellurium compound is selected from the group consisting of telluroureas, phosphinetellurides, telluroamides, telluroketones, telluroesters and isotellurocyanates.

8. The silver halide color photographic material of claim 5, wherein said silver halide grains are chemically sensitized in the presence of a silver halide solvent.

9. The silver halide color photographic material of claim 5, wherein said silver halide grains are chemically sensitized further by adding a sulfur compound.

10. The silver halide color photographic material of claim 5, wherein said silver halide grains are chemically sensitized in the presence of a compound represented by the following formula (II), formula (II)

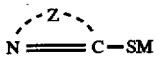

wherein Z represents an atomic group necessary to form a 5- or 6-membered ring and M represents a hydrogen atom, an alkali metal atom or an ammonium group.

11. The silver halide color photographic material of claim 5, wherein not less than 30% by number of total silver halide grains contained in the silver halide emulsion layer is accounted for by tabular silver halide grains each comprising two or more silver halide phases different in a silver iodide content from each other, a maximum silver iodide containing phase having a silver iodide content of not less than 5 mol % and less than 15 mol %; and said tabular grains having 5 or more dislocation lines per grain.

12. The silver halide color photographic material of claim 5, wherein, at a time during step (i), an iodide salt is introduced at a pAg of not more than 11.0 without addition of a halide salt other than the iodide.

13. The silver halide color photographic material of claim 11, wherein said iodide is introduced in the form of a water soluble iodide, silver iodide fine grains or a compound capable of releasing an iodide ion.

14. The silver halide color photographic material of claim 11, wherein said iodide is introduced at a time between after 50% of the total silver salt is added and before 95% of the total silver salt is added.

* * * * *